US006799010B2

(12) United States Patent
Namiki

(10) Patent No.: US 6,799,010 B2
(45) Date of Patent: Sep. 28, 2004

(54) IMAGE FORMING APPARATUS HAVING IMAGE CARRIER RELEASED FROM INTERMEDIATE TRANSFER BODY

(75) Inventor: Akiyo Namiki, Kanagawa (JP)

(73) Assignee: Ricoh Company, Tokyo (JP)

( * ) Notice: Subject to any disclaimer, the term of this patent is extended or adjusted under 35 U.S.C. 154(b) by 0 days.

(21) Appl. No.: 10/208,762

(22) Filed: Aug. 1, 2002

(65) Prior Publication Data

US 2003/0026630 A1 Feb. 6, 2003

(30) Foreign Application Priority Data

Aug. 2, 2001 (JP) ..... 2001-235360

(51) Int. Cl.[7] ..... G03G 15/01
(52) U.S. Cl. ..... 399/298; 399/299; 399/302
(58) Field of Search ..... 399/66, 298, 299, 399/302

(56) References Cited

U.S. PATENT DOCUMENTS

| | | | | |
|---|---|---|---|---|
| 6,014,532 | A | 1/2000 | Takeichi et al. | |
| 6,029,023 | A | 2/2000 | Munemori et al. | 399/66 |
| 6,060,205 | A | 5/2000 | Takeichi et al. | |
| 6,118,964 | A | 9/2000 | Kojima et al. | |
| 6,160,977 | A | 12/2000 | Takeichi et al. | |
| 6,173,141 | B1 | 1/2001 | Sakagami et al. | 399/167 |
| 6,356,732 | B1 | 3/2002 | Watanabe et al. | 399/299 |
| 6,363,237 | B1 | 3/2002 | Nagame et al. | |
| 6,370,343 | B1 | 4/2002 | Watanabe | 399/66 |
| 6,385,427 | B1 * | 5/2002 | Nakane | 399/298 |
| 6,449,451 | B2 * | 9/2002 | Tsuruya et al. | 399/299 X |
| 6,470,166 | B2 * | 10/2002 | Mizoguchi et al. | 399/302 |

FOREIGN PATENT DOCUMENTS

| | | |
|---|---|---|
| JP | 2000-352883 | 12/2000 |
| JP | 2001-100487 | 4/2001 |
| JP | 2001-296716 | 10/2001 |

OTHER PUBLICATIONS

European Search Report.

* cited by examiner

*Primary Examiner*—William J. Royer
(74) *Attorney, Agent, or Firm*—Oblon, Spivak, McClelland, Maier & Neustadt, P.C.

(57) ABSTRACT

An intermediate image transfer type, tandem color image forming apparatus of the present invention includes four photoconductive drums assigned to black, yellow, magenta and cyan, respectively. In a black mode, the drums assigned to the colors other than black are released from an intermediate image transfer belt. As soon as the trailing edge of a black toner image is transferred to the intermediate image transfer belt, the above drums are again brought into contact with the belt. The drums and intermediate image transfer belt therefore wear little despite contact thereof and deteriorate little despite pressure acting therebetween.

9 Claims, 11 Drawing Sheets

IMAGE FORMING APPARATUS HAVING IMAGE CARRIER RELEASED FROM INTERMEDIATE TRANSFER BODY

BACKGROUND OF THE INVENTION

1. Field of the Invention

The present invention relates to a copier, facsimile apparatus, printer or similar electrophotographic image forming apparatus. More particularly, the present invention relates to an image forming apparatus of the type including a plurality of image carriers, primary image transferring means for transferring images formed on the image carriers to an intermediate image transfer body one above the other to thereby form a composite image, and secondary image transferring means for transferring the composite image to a sheet or recording medium.

2. Description of the Background Art

Today, a color copier, color printer or similar color image forming apparatus is spreading and includes either a single photoconductive drum or a plurality of photoconductive drums arranged in a tandem configuration. In the color image forming apparatus including a single drum, a plurality of developing units are arranged around the drum, and each forms a toner image on the drum in a particular color. Toner images so formed on the drum are transferred to a sheet one above the other, completing a full-color image. In the tandem color image forming apparatus, toner images each are formed on one of the drums by a particular developing unit in a particular color and sequentially transferred to a sheet one above the other to form a full-color image.

The color image forming apparatus with a single drum is small size and low cost. However, to form a full-color image, the apparatus has to repeat image formation a plurality of times (usually four times) with the drum and is therefore not feasible for high-speed image formation. By contrast, the tandem image forming apparatus can form a full-color image with a plurality of (usually four) drums and therefore at high speed although it is bulky and high cost.

The tandem color image forming apparatus uses either one of a direct image transfer system and an indirect image transfer system. In the direct image transfer system, intermediate image transferring devices corresponding one-to-one to the drums transfer toner images of different colors from the drums to a sheet being conveyed by a conveying belt one above the other. In the indirect image transfer system, primary image transferring devices transfer toner images of different colors from the drums to an intermediate image transfer belt one above the other. Subsequently, a secondary image transferring device transfers the resulting full-color image from the intermediate image transfer belt to a sheet.

A problem with the direct image transfer system is that a sheet feeder and a fixing unit should be respectively positioned upstream and downstream of the plurality of drums arranged along the conveying belt, increasing the size of the apparatus body in the direction of sheet conveyance. By contrast, the indirect image transfer system allows the secondary image transfer devices to be relatively freely laid out, so that the sheet feeder and fixing unit can be arranged one above the other below the drums. This successfully reduces the overall size of the apparatus body.

Another problem with the direct image transfer system is that when the fixing unit is positioned near the most downstream drum in order to reduce the size in the direction of sheet conveyance, a sufficient path for a sheet to bend cannot be provided between the drum and the fixing unit. Consequently, the fixing unit is apt to adversely influence image formation effected at the upstream side due to an impact ascribable to the leading edge of a sheet entering the fixing unit or a difference between the speed of the sheet passing the fixing unit and the speed of the conveying belt. The indirect image transfer system guarantees a sufficient path for a sheet to bend and is therefore free from such a problem. For this reason, the tandem color image forming apparatus, particularly one using the indirect image transfer system, is attracting increasing attention.

However, in the indirect image transfer type, tandem color image forming apparatus, the surface of the intermediate image transfer body and the surfaces of the drums move in contact with each other at primary image transfer positions. The intermediate image transfer body and drums therefore wear little by little or their surface characteristics vary little by little. Although the above configuration is unavoidable for primary image transfer, even the drums other than the drum to be used must be held in contact with the intermediate image transfer body. For example, in a black mode, the drums other than the drum assigned to black must also be held in contact with the intermediate image transfer body. As a result, the life of such drums is shortened.

Technologies relating to the present invention are disclosed in, e.g., Japanese Patent Laid-Open Publication Nos. 2000-352883 and 2001-296716.

SUMMARY OF THE INVENTION

It is an object of the present invention to provide an image forming apparatus capable of reducing the deterioration of image carriers and an intermediate image transfer body contacting each other to thereby extend their lives.

An image forming apparatus of the present invention includes a plurality of image carriers and a plurality of toner image forming devices each for forming a toner image of a particular color on a respective image carrier. A primary image transferring device includes an intermediate image transfer body capable of contacting the image carriers. Toner images formed on the image carriers are sequentially transferred to the intermediate image transfer body one above the other by primary image transfer at positions where the image carriers contact the intermediate image transfer body, completing a composite toner image. A secondary image transferring device transfers the composite toner image from the intermediate image transfer body to a sheet or recording medium by secondary image transfer. The apparatus is selectively operable in a first mode that uses all of the toner image forming devices or a second mode that uses at least one toner image forming device, but does not use at least one toner image forming device. In the second mode, the image carrier associated with the toner image forming device not joining in image formation is released from the surface of the intermediate image transfer body at least until the end of the primary image transfer.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
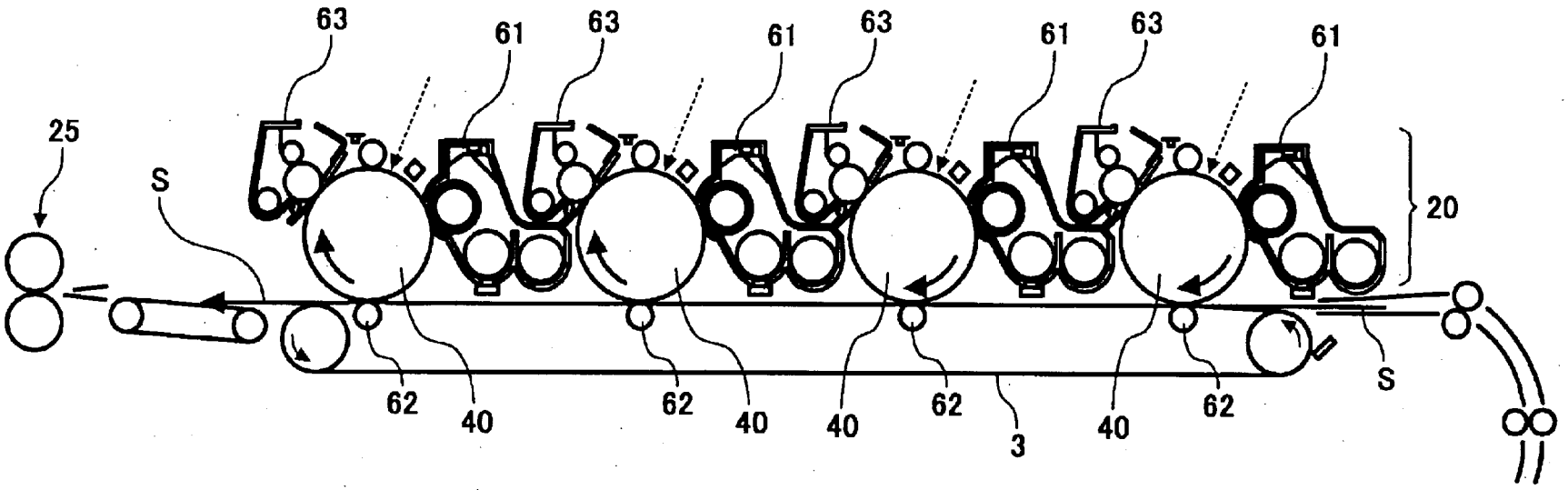
FIG. 1 PRIOR ART
FIG. 1 is a view showing a conventional direct image transfer type, tandem image forming apparatus.

To better understand the present invention, brief reference will be made to a conventional direct image transfer type, tandem color image forming apparatus, shown in FIG. 1. As shown, the image forming apparatus includes an image forming section 20 including a plurality of photoconductive drums 40 arranged side by side along an endless conveying belt 3. One developing unit 61, one image transferring device 62 and one drum cleaner 63 are assigned to each of the drums 40. The image transferring devices 62 sequentially transfer toner images formed on the drums 40 by the respective developing units 61 to a sheet S, which is being conveyed by the conveying belt 3, one above the other, thereby completing a full-color image. A fixing unit 25 fixes the full-color image on the sheet S.

Figure 2:
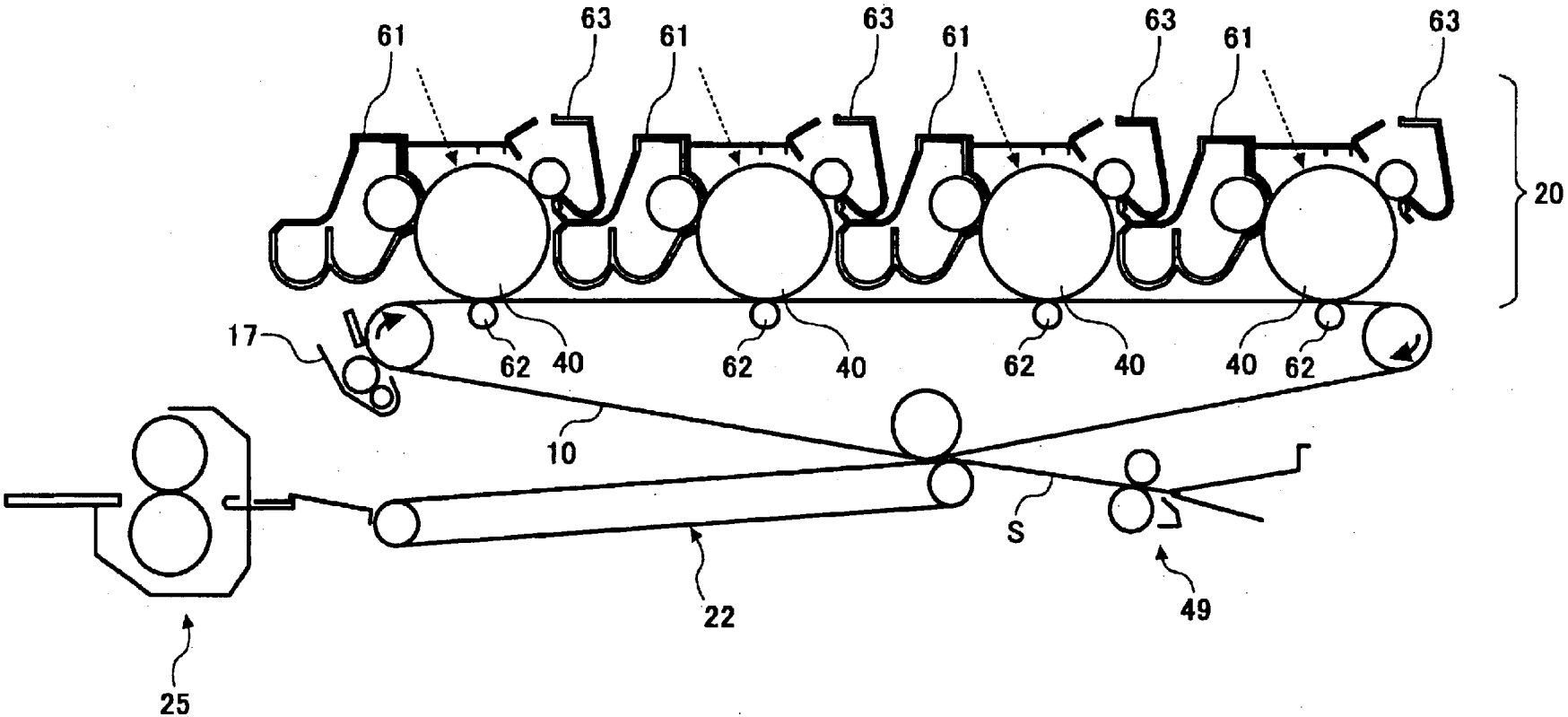
FIG. 2 PRIOR ART
FIG. 2 is a view showing a conventional indirect image transfer type, tandem image forming apparatus.

FIG. 2 shows a conventional indirect image transfer type, tandem color image forming apparatus. As shown, the image forming apparatus includes an image forming section 20 in which toner images formed on photoconductive drums 40 by the respective developing units 61 are sequentially transferred to an endless, intermediate image transfer belt (simply belt hereinafter) 10 one above the other by primary image transferring devices 62 (primary image transfer). The resulting full-color image formed on the belt 10 is transferred to a sheet S by a secondary image transferring device 22 (secondary image transfer); the sheet S is fed from a sheet feeder, not shown, via a registration roller pair 49. A fixing unit 25 fixes the full-color image on the sheet S. The reference numeral 17 designates a belt cleaner assigned to the belt 10.

While the indirect image transfer type, tandem color image forming apparatus is attracting increasing attention, it has the previously discussed problem left unsolved.

Figure 3:
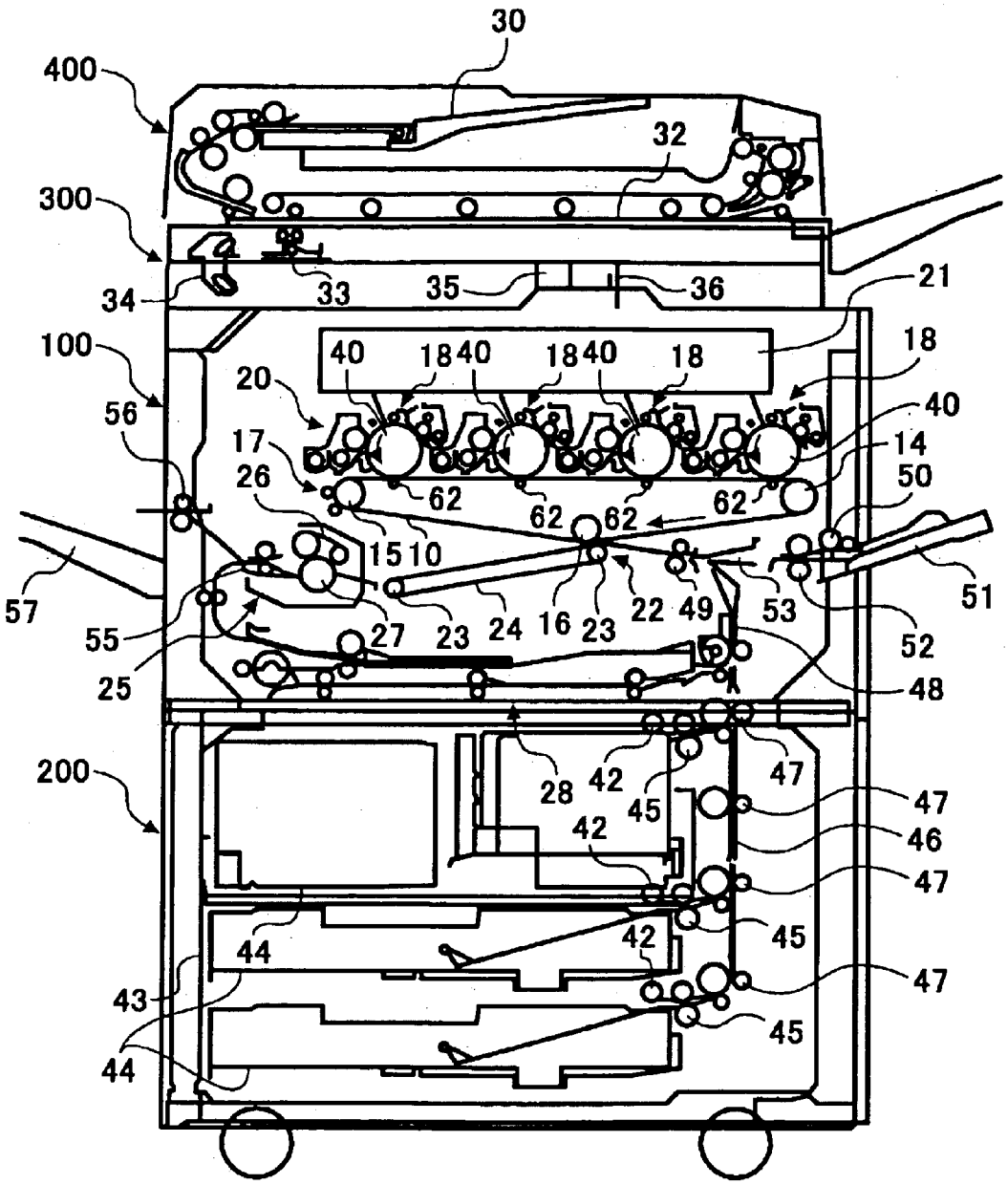
FIG. 3 is a view showing an image forming apparatus embodying the present invention.

Referring to FIG. 3 of the drawings, an indirect image transfer type, tandem color image forming apparatus embodying the present invention is shown and implemented as a color copier by way of example. As shown, the color copier is generally made up of a copier body 100, a sheet feed table 200 on which the copier body 100 is mounted, a scanner 300 mounted on the copier body 100, and an ADF (Automatic Document Feeder) 400 mounted on the scanner 300.

Figure 4:
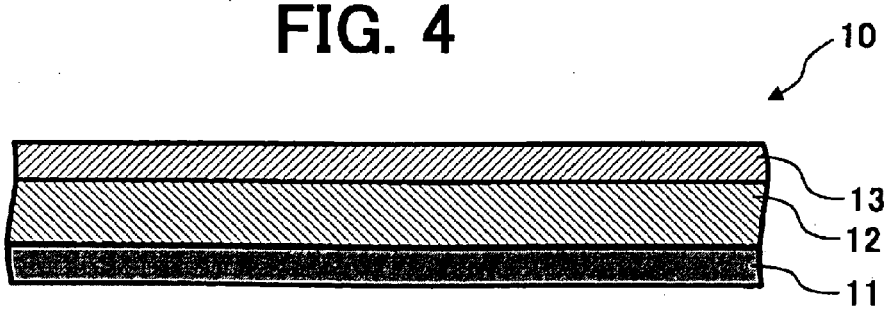
FIG. 4 is a fragmentary section of an intermediate image transfer body included in the illustrative embodiment.

The copier body 100 includes an endless, intermediate image transfer belt (simply intermediate belt hereinafter) 10, which is a specific form of an intermediate image transfer body. As shown in FIG. 4, the intermediate belt 10 is made up of a base layer 11, an elastic layer 12 and a coat layer 13 sequentially stacked in this order from the bottom to the top. The base layer 10 is formed of, e.g., fluorocarbon resin having low stretchability or rubber having high stretchability and canvas covering such a material. The elastic layer 12 is formed of, e.g., fluorine-contained rubber or acrylonitrile-butadien copolymer rubber. The coat layer is implemented by, e.g., fluorine-contained rubber and provided with high smoothness.

As shown in FIG. 3, the intermediate belt 10 is passed over a plurality of rollers, i.e., three rollers 14, 15 and 16 in the illustrative embodiment and movable clockwise, as indicated by an arrow. A belt cleaner 17 is positioned at the left-hand side of the roller 15, as viewed in FIG. 3, in order to clean the surface of the intermediate belt 10 after image transfer. Cyan, magenta, yellow and black image forming means 18 are arranged side by side above part of the intermediate belt 10 extending between the rollers 14 and 15 in the direction of movement of the intermediate belt 10, constituting a tandem image forming section 20.

An optical writing device 21 is positioned above the image forming section 20. A secondary image transferring device 22 is positioned at the opposite side to the intermediate belt 10 with respect to the image forming section 20 and includes an endless, secondary image transfer belt (simply secondary belt hereinafter) 24 passed over rollers 23. The secondary belt 24 is pressed against the roller 16 via the intermediate belt 10, so that a toner image can be transferred from the intermediate belt 10 to a sheet or recording medium. A fixing device 25 is positioned downstream of the secondary image transferring device 22 for fixing the toner image on the sheet. The fixing device 25 includes an endless fixing belt 26 and a press roller 27 pressed against the fixing belt 26.

The secondary image transferring device 22 serves to convey the sheet to the fixing device 25 at the same time. Of course, the secondary image transferring device 22 may be implemented as a transfer roller or a non-contact type charger although it is difficult to provide such a device with the above additional function. A sheet turning device 28 is arranged below the secondary image transferring device 22 and fixing device 25 in parallel to the image forming section 20. The sheet turning device 28 is used to form images on both sides of a sheet in a duplex copy mode.

In operation, the operator stacks desired documents on a document tray 30 included in the ADF 40 or opens the ADF 40 upward, sets a document on a glass platen 32 included in the scanner 300, and then closes the ADF 400 downward to press the document. Subsequently, the operator presses a start switch not shown. In response, in the former case, the scanner 300 is driven after one document has been conveyed by the ADF 400 to the glass platen 32. In the latter case, the scanner 300 is driven immediately after the document has been set on the glass platen 32. In any case, a first carriage 33 and a second carriage 34 included in the scanner 300 move with a light source mounted on the first carnage 33 illuminating the document. The resulting reflection from the document is incident to a mirror mounted on the second carriage 34. The mirror reflects the incident light toward an image sensor 36 via a lens 35, 50 that the image sensor 36 reads the document image represented by the light.

When the start switch is pressed, a drive motor, not shown, causes one of the rollers 14 through 16 to rotate and thereby causes the intermediate belt 10 to move; the other rollers are rotated by the intermediate belt 10. At the same time, in each of the four image forming means 18, a photoconductive drum or image carrier 40 is rotated to form a toner image with particular one of cyan, magenta, yellow and black toner. Such toner images are sequentially transferred from the drums 40 to the intermediate belt 10 one above the other, completing a full-color image on the intermediate belt 10.

Further, when the start switch is pressed, one of pickup rollers 42 included in the sheet feed table 200 is driven to pay out a sheet from associated one of sheet cassettes 44, which are arranged one above the other in a paper bank 43. At this instant, a reverse roller 45 cooperates with the pickup roller 42 to separate the above sheet from the other sheets. The sheet paid out is introduced into a sheet path 46. Rollers 47 arranged on the sheet path convey the sheet toward a registration roller 49 via a sheet path 48 arranged in the copier body 100. When the operator feeds sheets via a manual feed tray 51 by hand, a pickup roller 50 associated with the manual feed tray 51 is rotated to pay out one sheet toward a sheet path 53 in cooperation with a reverse roller 52. The sheet path 53 also extends toward the registration roller 49.

The registration roller 49 once stops the sheet conveyed thereto and then drives it in synchronism with the full-color image transferred to the intermediate belt 10. When the sheet arrives at a nip between the intermediate belt 10 and the secondary image transferring device 22, the secondary image transferring device 22 transfers the full-color image from the intermediate belt 10 to the sheet. The secondary image transferring device 22 conveys the sheet carrying the image thereon to the fixing device 25. The fixing device 25 fixes the image on the sheet with heat and pressure to thereby fix the former on the latter. A path selector 55 steers the sheet with the fixed image, i.e., a copy to a copy tray 57 via an outlet roller 56. In a duplex copy mode, the path selector 55 is switched to steer the above sheet into the sheet turning device 28. The sheet turning device 28 turns the sheet and again feeds it to the nip between the intermediate belt 10 and the secondary image transferring device 22. As a result, another full-color image is formed on the other side of the same sheet. The resulting duplex copy is driven out to the copy tray 57 via the outlet roller 56.

After the image transfer, the belt cleaner 17 removes the toner left on the intermediate belt 10 to thereby prepare the intermediate belt 10 for the next image forming cycle.

While the registration roller 49 is, in many cases, connected to ground, a bias may be applied to the registration roller 49 in order to remove paper dust. For this purpose, the registration roller 49 may have a diameter of 18 mm and covered with conductive rubber, e.g., 1 mm thick conductive NBR (nitrile rubber). This kind of registration roller 49 has a volume resistivity of $10^9$ Ω·cm. A voltage of about −800 V is applied to the surface of the registration roller 49. A voltage of about +200 V is applied to the reverse side of the sheet. Generally, in the intermediate image transfer system, paper dust cannot easily move to the drums 40 so that the transfer of paper dust does not have to be taken into account. This is why the registration roller 49 is usually connected to ground. While the voltage is generally implemented as a DC bias, it may alternatively be implemented as an AC voltage containing a DC offset component.

The sheet moved away from the biased registration roller 49 has its front side slightly charged to the negative side. Consequently, as for secondary image transfer from the intermediate belt 10 to the sheet, image transfer conditions are sometimes varied, compared to the case wherein the bias is not applied to the registration roller 49.

Figure 5:
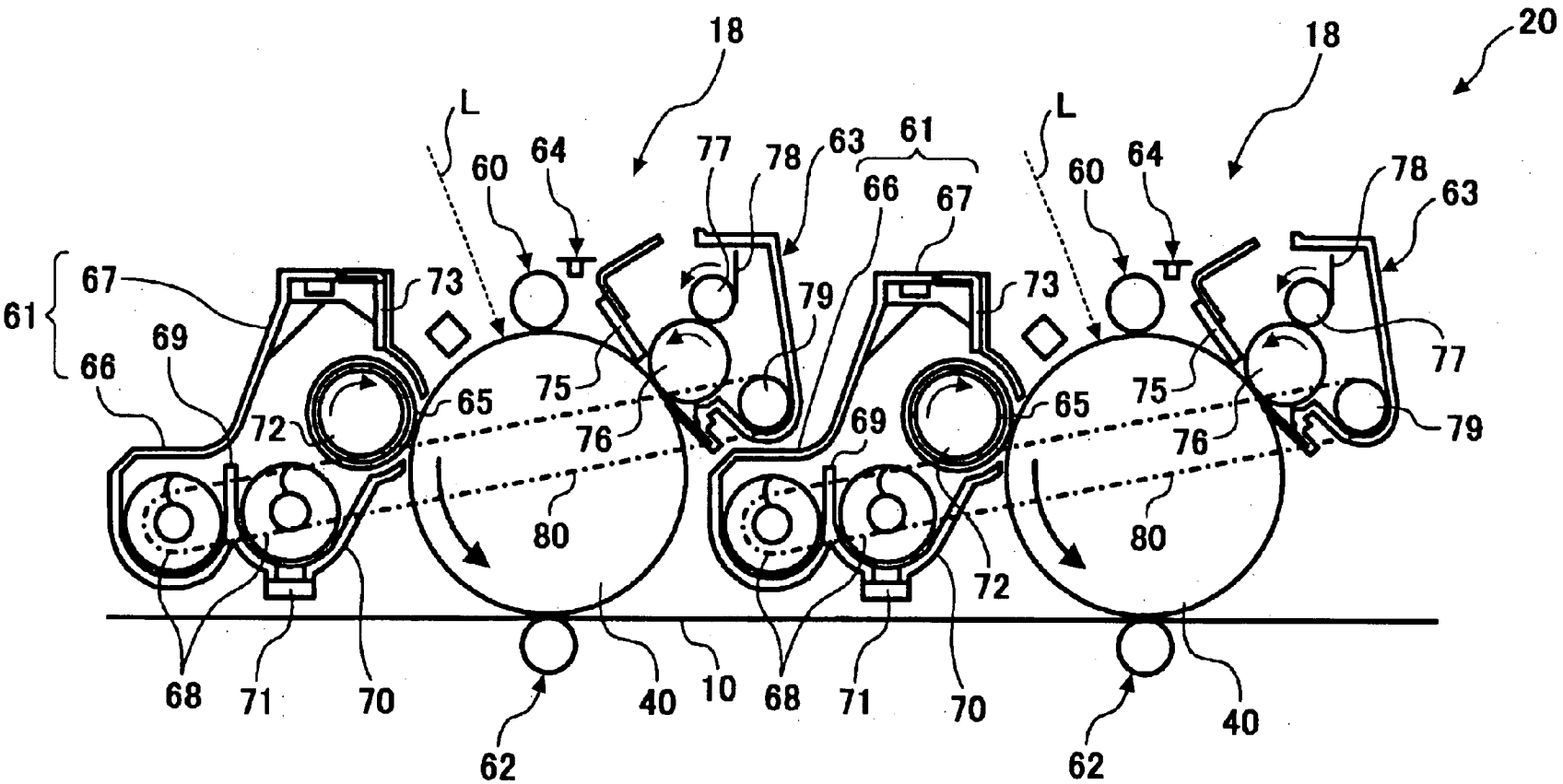
FIG. 5 is a fragmentary enlarged view of a tandem, color image forming section included in the illustrative embodiment.

FIG. 5 is a fragmentary enlarged view showing the image forming section 20. As shown, each image forming means 18 includes a charger 60, a developing device 61, a primary image transferring device 62, a drum cleaner 63 and a discharger 64 arranged around the drum 40. Each image forming means 18 may be partly or entirely implemented as a process cartridge removable from the copier body 100 for promoting easy maintenance. In the illustrative embodiment, the charger 60 is implemented as a roller contacting the drum 40 and uniformly charges the surface of the drum 40. The charger 60 may, of course, be implemented as a scorotron charger not contacting the drum 40.

While the developing device 61 may use a single-ingredient type developer, i.e., toner, it uses a two-ingredient type developer, i.e., a mixture of magnetic carrier grains and nonmagnetic toner grains in the illustrative embodiment. In the developing device 61, an agitating section 66 deposits the two-ingredient type developer on a sleeve 65 while agitating it. A developing section 67 transfers the toner grains of the developer from the sleeve 65 to the drum 40. The agitating section 66 is positioned at a lower level than the developing section 67.

Figure 6:
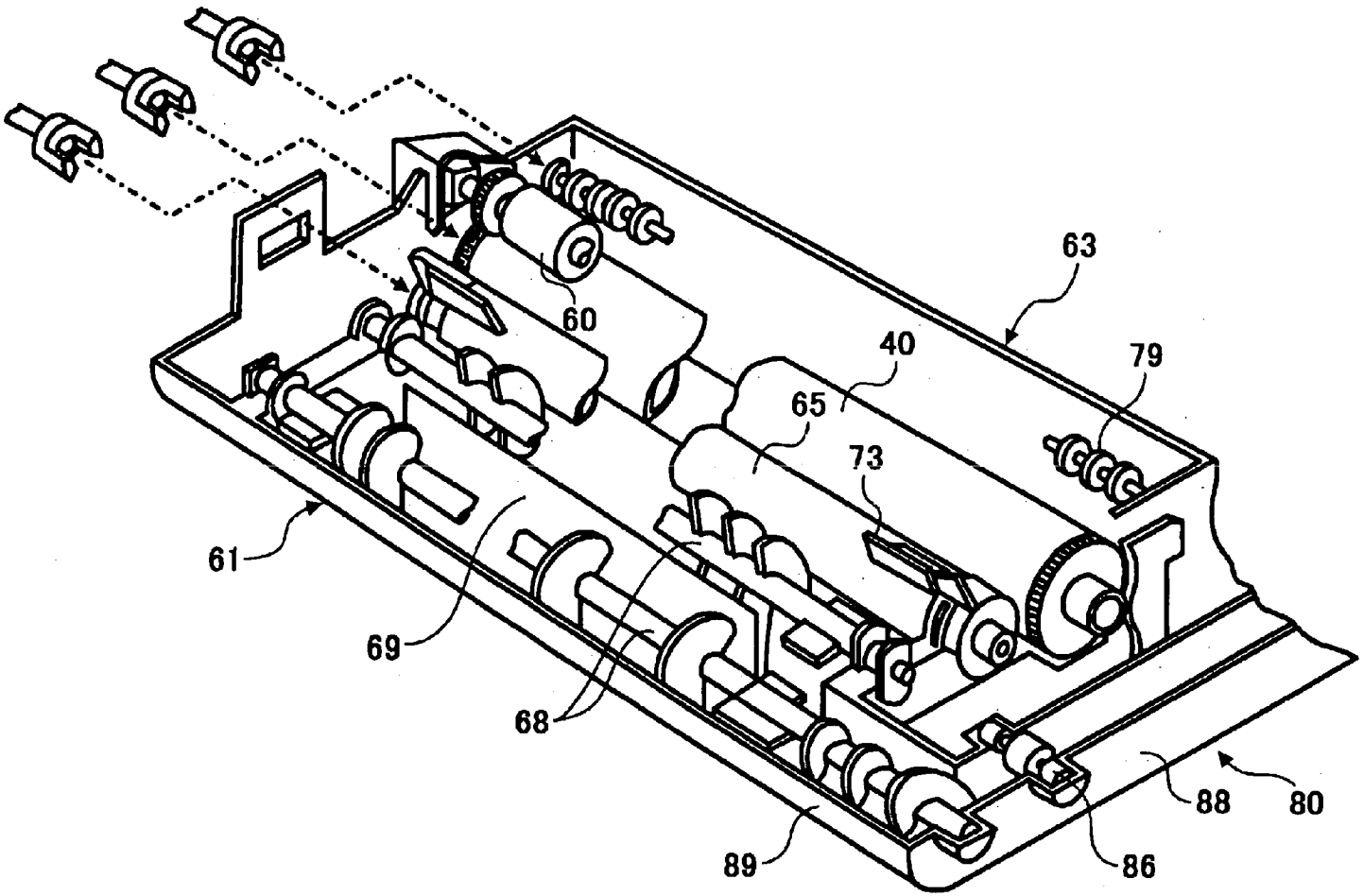
FIG. 6 is an isometric view showing a toner recycling device included in the illustrative embodiment.

The agitating section 66 includes two parallel screws 68. As shown in FIG. 6, a partition 69 isolates the two screws 68 except for opposite ends of the screws 68. A toner content sensor 71 is mounted on a casing 70 included in the developing device 61.

In the developing section 67, the sleeve 65 faces the drum 40 through an opening formed in the casing 70. A magnet 72 is held stationary within the sleeve 65. A doctor blade 73 has an edge adjoining the sleeve 65. In the illustrative embodiment, the shortest distance between the doctor blade 73 and the sleeve 73 is selected to be 500 μm.

The screws 68 in rotation agitate and circulate the developer while conveying it to the sleeve 65. The developer is then scooped up and deposited on the sleeve 65 by the magnet 72, forming a magnet brush on the sleeve 65. The doctor blade 73 regulates the thickness of the magnet brush being conveyed in accordance with the rotation of the sleeve 65. Part of the developer removed by the doctor blade 73 is returned on the agitating section 66.

A bias is applied to the sleeve 65 to transfer the toner of the developer deposited on the sleeve 65 to the drum 40. The toner develops a latent image electrostatically formed on the drum 40. Part of the developer left on the sleeve 65 after the development is released from the sleeve 65 at a position where the force of the magnet 72 does not act, and returned to the agitating section 66. When the toner content of the developer decreases as a result of repeated development, as determined by the toner content sensor 71, fresh toner is replenished to the agitating section 66.

In the illustrative embodiment, the drum 40 and sleeve 65 are respectively driven at linear velocities of 200 mm/sec and 240 mm/sec by way of example. The drum 40 and sleeve 65 are provided with diameters of 50 mm and 18 mm, respectively. The amount of charge deposited on the toner on the sleeve 65 should preferably be between −10 μC/g and −30 μC/g. A development gap GP between the drum 40 and the sleeve 65 may be between 0.8 mm and 0.4 mm as conventional; the smaller the gap GP, the higher the developing efficiency. A photoconductive layer formed on the drum 40 is 30 μm thick while a light beam L to issue from the optical writing unit has a spot diameter of 50×60 μm and a quantity of 0.47 mW. The charge potential on the drum 40 is −700 V before exposure (VO) or −120 V after exposure (VL). The bias for development is −470 V, i.e., the potential for development is 350 V.

Each primary image transferring device 62 is implemented as a roller pressed against the drum 40 via the intermediate belt 10. The roller may, of course, be replaced with a conductive brush or a corona charger that does not contact the intermediate belt 10.

The drum cleaner 63 includes a cleaning blade 75 formed of, e.g., polyurethane and having an edge pressed against the drum 40. A contact brush is used in combination with the cleaning blade 75 for enhancing the cleaning ability. In the illustrative embodiment, the contact brush is implemented as a conductive fur brush 76 contacting the circumference of the drum 40 and rotatable in a direction indicated by an arrow in FIG. 5. A metallic, electric field roller 77 is rotatable in a direction indicated by an arrow in FIG. 5 and applies a bias to the fur brush 76. A scraper 78 has an edge pressed against the electric field roller 77. Further, a collection screw 79 is used to collect the removed toner.

More specifically, the fur brush 67 rotates in a direction counter to the drum 40 to remove the toner left on the drum 40 after image transfer. The toner deposited on the fur brush 76 is removed by the electric field roller 77, which rotates in a direction counter to the fur brush 76 while being applied with a bias. The toner collected by the electric field roller 77 is removed by the scraper 78. The toner so collected by the drum cleaner 63 is conveyed by the collection screw 79 to one side of the drum cleaner 63. A toner recycling device, which will be described layer, returns such toner from the drum cleaner 63 to the developing device 61 to thereby allow it to be reused.

The discharger 64 initializes the cleaned surface of the drum 40 to thereby prepare it for the next image forming cycle and may be implemented as a quenching lamp.

While the drum 40 is in rotation, the charger 60 uniformly charges the surface of the drum 40. The optical scanning device 21 scans the charged surface of the drum 40 with a light beam L output from a laser or an LED array in accordance with image data output from the scanner 300, thereby forming a latent image on the drum 40. The developing device 61 develops the latent with the toner to thereby form a corresponding toner image. The primary image transferring device 62 transfers the toner image to the intermediate belt 10. After the image transfer, the drum cleaner 63 removes the toner left on the drum 40. Subsequently, the discharger 64 discharges the surface of the drum 40 to thereby prepare it for the next image forming cycle.

Figure 7:
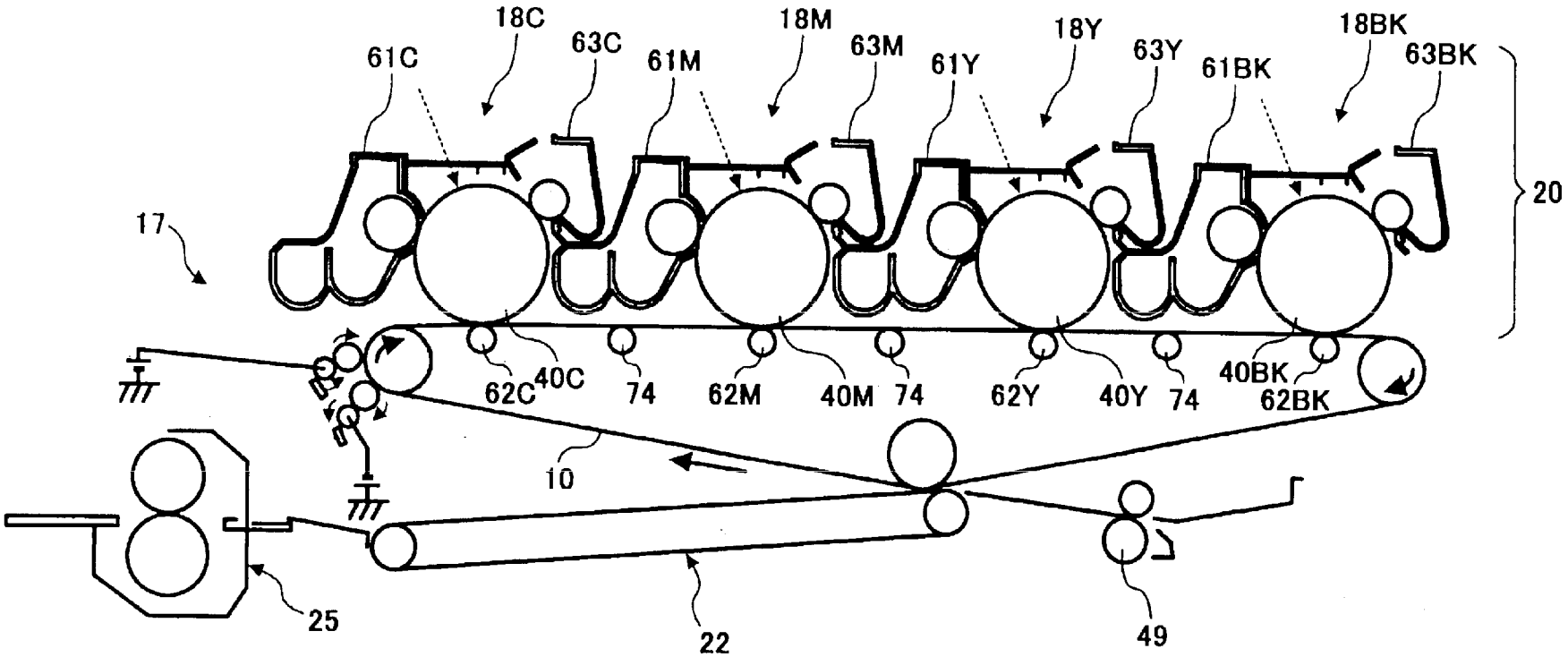
FIG. 7 is a fragmentary enlarged view of the illustrative embodiment.

FIG. 7 shows an essential part of the copier of FIG. 3. In FIG. 7, the image forming means 18 and the drums 40, developing devices 61 and drum cleaners 63 thereof and primary image transferring devices respectively assigned to cyan, magenta, yellow and black are distinguished by suffices C, M, Y and BK. Conductive rollers 74, which are not shown in FIG. 3 or 5, each are positioned between nearby primary image transferring devices 62 and held in contact with the base layer 11 of the intermediate belt 10. Each conductive roller 74 prevents the bias applied from the associated primary image transferring device 62 from flowing to the adjoining image forming means 18 via the base layer 11, which has medium resistance.

Figure 8:
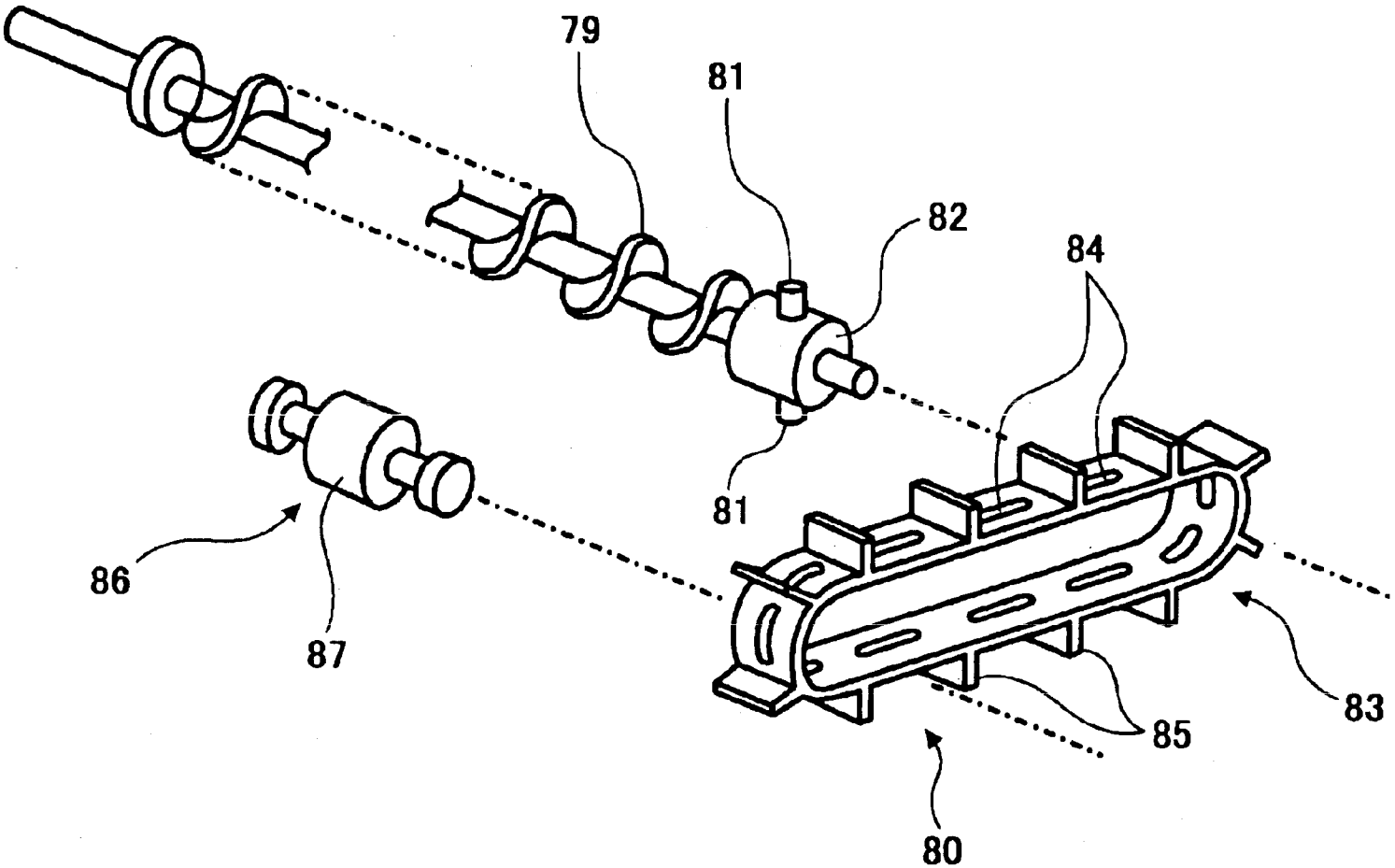
FIG. 8 is a fragmentary enlarged view showing the assembly of the toner recycling device.

Reference will be made to FIGS. 6 and 8 for describing the toner recycling device mentioned earlier. As shown in FIG. 8, one end of the collection screw 79 of each drum cleaner 63 is implemented as a roller portion 82 on which pins 81 are studded. The toner recycling device, generally 80, includes a toner conveying member 83 in the form of a belt that is passed over the roller portion 82 at one end thereof. The pins 81 each are received in one of slots 84 formed in the toner conveying member 84. Blades 85 are positioned on the outer surface of the toner conveying member 83 at preselected intervals. The other end of the toner conveying member 83 is passed over a roller portion 87 included in a rotary shaft 86.

The toner conveying member 83 and rotary shaft 86 are accommodated in a conveyance path case 88 shown in FIG. 6. The conveyance path case 88 is molded integrally with a cartridge case 89 and receives one of the two screws 68 of the developing device 61 at its end portion adjoining the developing device 61. In this configuration, a torque is transmitted from the outside to the collection screw 79 for causing the collection screw 79 and therefore the toner conveying member 83 to rotate. Consequently, the screw 68 received in the conveyance path case 88 conveys the toner collected by the drum cleaner 63 into the developing device 61. Subsequently, the two screws 68 circulate the collected toner while agitating it together with the developer existing in the developing device 61. The resulting mixture is deposited on the sleeve 65 and then regulated by the doctor blade 73, as stated earlier.

Now, if the drum 40 is constantly held in contact with the intermediate belt 10, then the drum 40 and intermediate belt 10 both deteriorate at the contact position and have their lives shortened. The illustrative embodiment reduces such deterioration with the following unique arrangements.

In a full-color mode, the drums 40Y, 4GM, 40C and 40BK all are brought into contact with the intermediate belt 10. On the other hand, in a black mode, the drums 40Y, 4GM and 40C other than the drum 40BK are released from the intermediate belt 10. To selectively move the drums 40Y, 40M and 40C into or out of contact with the intermediate belt 10, use may be made of a solenoid, clutch or any other suitable means.

Figure 9:
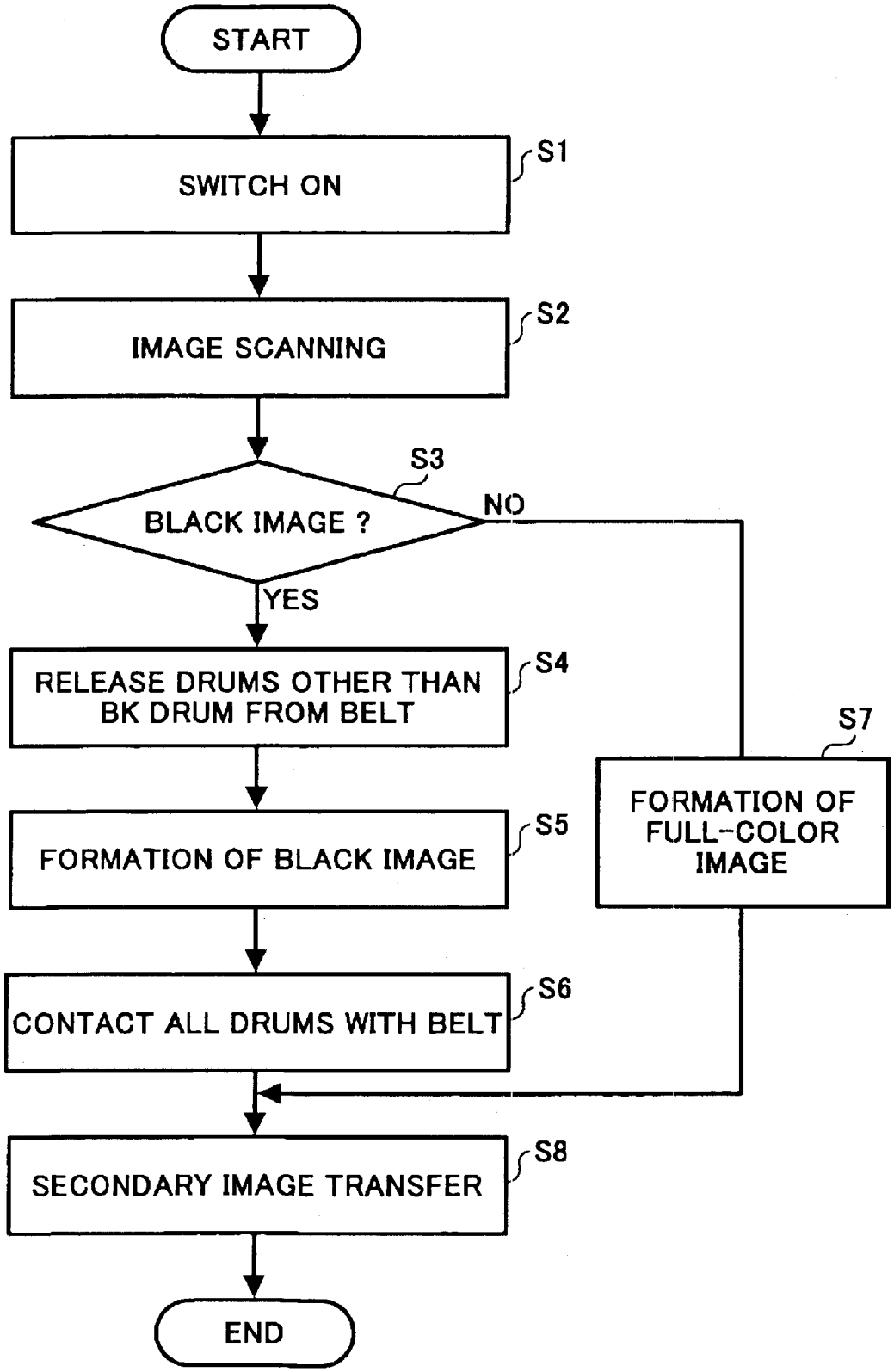
FIGS. 9, 10 and 11 are flowcharts each demonstrating a specific operation of the illustrative embodiment.

A first to a third specific operation of the illustrative embodiment will be described hereinafter. As shown in FIG. 9, in a first specific operation, when the operator lays a desired documents on the glass platen 32 of the scanner 300 and then presses the start switch (step S1), the scanner 300 reads the document (step S2). Subsequently, whether or not an image read out of the document is a black image is determined (step S3). If the answer of the step S3 is positive (YES), then it is determined that a second mode assigned to a black image is to be executed. In the second mode, the drums 40Y, 40M and 40C are released from the intermediate belt 10 (step S4). In this condition, an image is formed in black and then transferred to the intermediate belt 10 (step S5). As soon as the trailing edge of the black image is transferred to the intermediate belt 10, the drums 40Y, 40M and 40C are again brought into contact with the belt 10 (step S6).

If the answer of the step S3 is negative (NO), meaning that the document image is not a black image, then it is determined that a first mode assigned to a full-color image is to be executed. In the first mode, images of different colors are formed on all of the drums 40Y through 40BK contacting the intermediate belt 10 (step S7). The images are then transferred from the drums 40Y through 40BK to the intermediary belt 10 one above the other (primary image transfer).

After the step S6 or S7, the black image or the full-color image, respectively, is transferred to a sheet (secondary image transfer) (step S8).

As stated above, in the first specific operation, the drums 40Y, 40M and 40C not necessary for the black mode are released from the intermediate belt 10. This successfully reduces the deterioration of the drums 30Y, 40M and 40C and intermediate belt 10 ascribable to wear and contact pressure for thereby extending their lives. Further, the drums 40Y, 40M and 40C are released from the intermediate belt 10 only in the black mode used more frequently than the full-color mode. It is therefore not necessary to move the drums 40Y, 40M and 40C into and out of contact with the intermediate belt 10 one by one, so that the moving mechanism is simplified.

Figure 10:
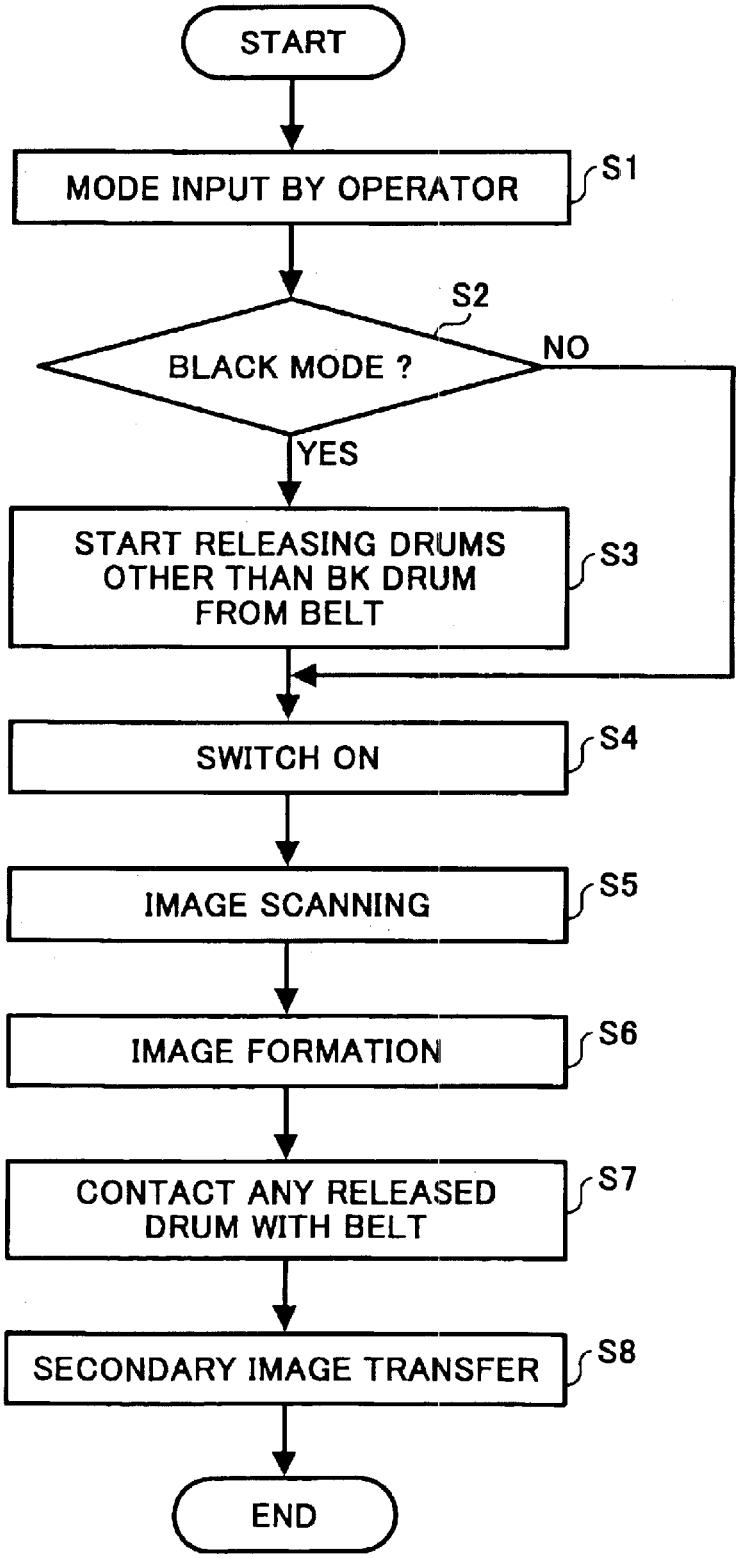

FIG. 10 shows a second specific operation that allows the operator to select either one of the black mode and full-color mode on an inputting section not shown. As shown, the operator selects either the black mode or the full-color mode on the inputting section (step S1). In response, whether or not the input mode is the black mode or not is determined (step S2). If the answer of the step S2 is YES, then it is determined that the second mode or black mode is to be executed. In this case, the drums 40Y, 40M and 40C other than the drum 40BK start being released from the intermediate belt 10 (step S3).

If the answer of the step S2 is NO, then it is determined that the first mode or full-color mode is to be executed. Therefore, the drums 40Y through 40BK all are held in contact with the intermediate belt 10. Subsequently, when the operator presses the start switch (step S4), a document is read (step S5). The document image read is formed in the mode selected by the user and then transferred to the intermediate belt 10 (primary image transfer) (step S6) If any one of the drums 40Y, 40M and 40C is spaced from the intermediate belt 10 at the end of primary transfer of the trailing edge of the black image, then such a drum is brought into contact with the belt 10 (step S7). Thereafter, the image is transferred from the intermediate belt 10 to a sheet (secondary image transfer) (step S8).

As stated above, the second specific operation allows the user to select the color of an image to be output without regard to the color of a document. For example, even when the document image is not a black image, the operator can select the black mode if it is more desirable than the color mode. In addition, there can be reduced the deterioration of the drums 40Y, 40M and 40C and intermediate belt 10 as well as cost.

Further, just after the operator has input the desired mode before image scanning, the second specific procedure starts releasing the drums 40Y, 40M and 40C from the intermediate belt 10. The drums 40Y, 40M and 40C can therefore start being released from the intermediate belt 10 before or during image scanning, obviating a waiting time up to the release of the drums 40Y, 40M and 40C after image scanning. The second operation therefore reduces an image forming time, compared to the first procedure.

A third specific operation will be described with reference to FIG. 11. The first and second operations each sequentially execute image scanning and image formation image data by image data. However, when a plurality of different image data are continuously input to the copier, e.g., the copying of a plurality of different kinds of documents and the printing of facsimile data are commanded at the same time, black images and full-color images should sometimes be continuously output. In such a case, the drums 40Y, 40M and 40C must be repeatedly moved into and out of contact with the intermediate belt 10 a number of times, consuming an extra time and extra power. In light of this, the third specific operation to be described uses two memories each being assigned to images of a particular mode.

Figure 11:
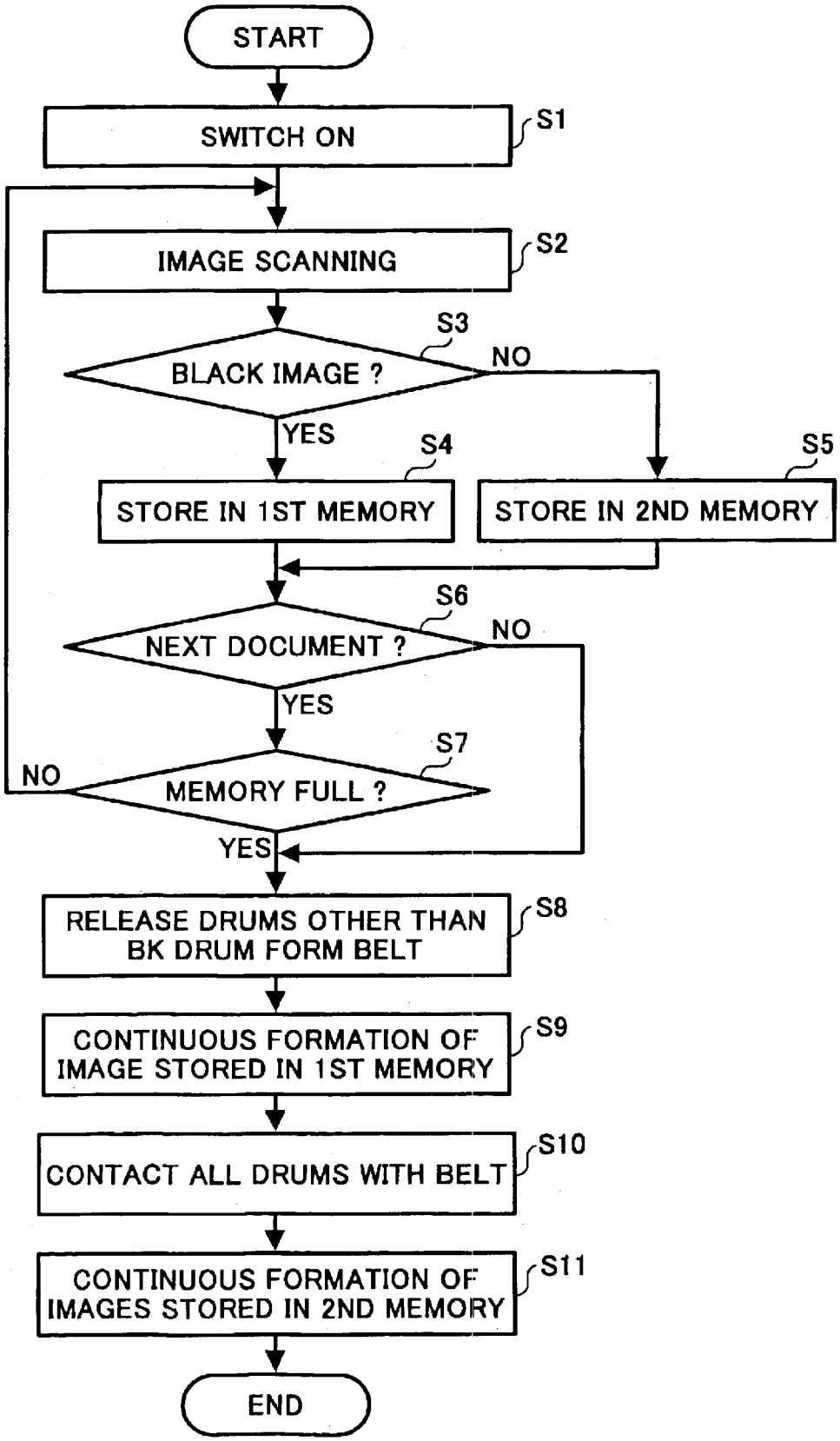

More specifically, as shown in FIG. 11, when the operator stacks a plurality of different kinds of documents and then presses the start switch (step S1), the scanner reads image data out of the first document (step S2). Subsequently, whether or not the scanned document image is a black image or not is determined (step S3). If the answer of the step S3 is YES, then the document image is written to a first memory assigned to black images (step S4). If the answer of the step S3 is NO, then the document image is written to a second memory assigned to full-color images (step S5). After the step S4 or S5, whether or not the next document is present is determined (step S6). If the answer of the step S6 is YES, then whether or not the black memory or the full-color memory has reached its preselected capacity (step S7). If the answer of the step S7 is NO, then the step S2 is repeated for reading the next document.

If the answer of the step S6 is NO or if the answer of the step S7 is YES, then the drums 40Y, 40M and 40C are released from the intermediate belt 10 (step S8). Subsequently, the image stored in the black memory is formed in black and then transferred to a sheet by primary and secondary image transfer (step S9). After all the image data stored in the black memory have been output, the drums 40Y, 40M and 40C are again brought into contact with the intermediate belt 10 (step S10). Subsequently, the image stored in the full-color memory is formed in four colors and then transferred to a sheet by primary and secondary image transfer (step S11).

In this specific operation, when desired documents include both of black documents and full-color documents, black images are continuously formed, and then full-color images are continuously formed, as stated above. This reduces the number of times of movements of the drums 40Y, 40M and 40C into and out of contact with the intermediate belt 10 and thereby saves time and power. While the third operation copies a plurality documents read by the scanner, it is similarly practicable even when image data representative of such documents are mixed with image data output from, e.g., a facsimile apparatus or a printer. It is noteworthy that the memories stated above do not increase the cost or the size of the copier because large-capacity memories available on today's market are low cost and small size.

In the first to third specific operations described above, black toner is consumed more than yellow toner, magenta toner or cyan toner. This is a matter of general knowledge because not only full-color documents and black documents are often dealt with together, but also a black portion sometimes occupies a major part of a full-color image. Moreover, today, a multiplex machine having not only a copier function but also a printer function and a facsimile function is spreading because its image forming section saves space and cost. The multiplex machine consumes more black toner than the other image forming apparatuses. In light of this, in the illustrative embodiment, black toner is stored in a greater amount than toner of the other colors, as will be described hereinafter.

Figure 12:
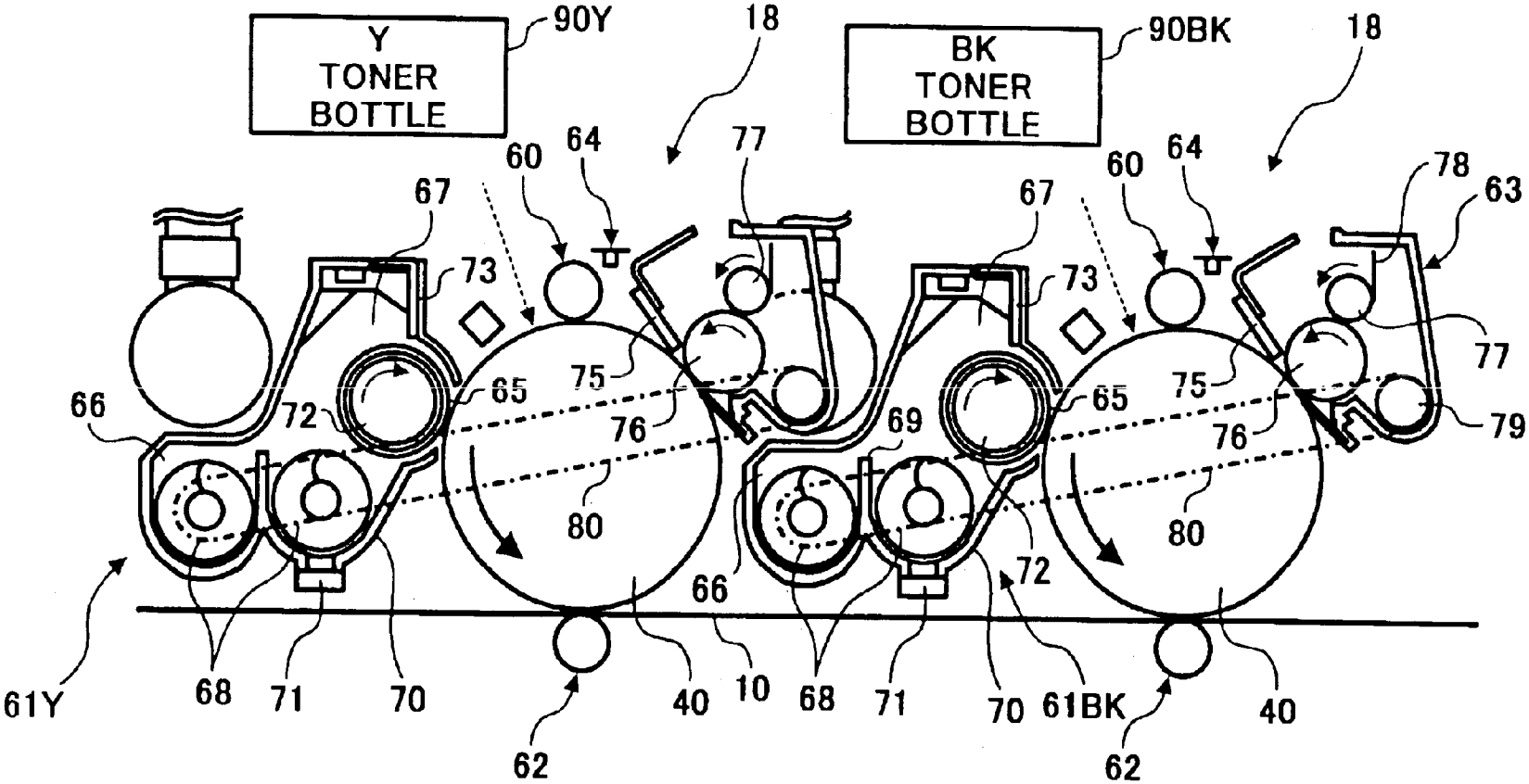
FIG. 12 is an enlarged fragmentary view showing toner bottles included in the illustrative embodiment together with arrangements around the toner bottles.

As shown in FIG. 12, a black toner bottle 90BK stores black toner to be replenished to the developing device 61BK. The black toner bottle 90BK has a capacity substantially 1.5 times as great as the capacity of a yellow toner bottle 90Y, which stores yellow toner. Toner bottles 90M and 90C storing magenta toner and cyan toner, respectively, each are identical in capacity with the yellow toner bottle 90Y. To replenish toner from any one of the toner bottles 90 to the associated developing device 61, a pump disposed above the agitating section 66 is driven to feed the toner from the toner bottle 90 to the agitating section 66. The black toner bottle 90BK greater in capacity than the other toner bottles 90Y, 90M and 90C does not have to be frequently replaced despite that black toner is consumed more than the other toner. This facilitates users maintenance.

In the first to third operations described above, in the black mode, the drums 40Y, 40M and 40C other than the drum 40BK are released from the intermediate belt 10. If desired, the drive of the developing devices 61Y, 61M and 61C including the drums 40Y, 40M and 40C so released may additionally be interrupted. This interrupts the operation of the members arranged in the developing sections 67 and agitating sections 66 of the developing devices, which do no join in image formation, and thereby obviates deterioration and further saves power.

While in the illustrative embodiment the drums 40Y through 40BK are arranged such that a black toner image is transferred to the intermediate belt 10 last, such an arrangement is only illustrative. Also, the intermediate belt 10 may be replaced with any other suitable intermediate image transfer body so long as it can support toner images thereon.

Further, the first to third specific operations selectively move the drums 40 into or out of contact with the intermediate belt 10 on the basis of two different modes, i.e., black mode and frill-color mode. Such two modes are only illustrative. Alternatively, an arrangement may be made such that the drums 40 of colors not used are released from the intermediate belt 10 one by one. This can be done if any of the colors, e.g., black, yellow, magenta and cyan not to be used are sensed color by color. This kind of arrangement, however, increases the total frequency of movement of the individual drum 40 into and out of contact with the intermediate belt 10 and thereby slows down image formation.

In summary, it will be seen that the present invention provides an image forming apparatus having various unprecedented advantages, as enumerated below.

(1) The deterioration of image carriers and an intermediate image transfer body ascribable to contact is reduced. This extends the service lives of the image carriers and intermediate image transfer body.

(2) In a black mode, the image carriers to join in image formation in colors other than black are released from the intermediate image transfer body. Therefore, even when black images are formed more often than full-color images, the image carriers assigned to colors other than black and the intermediate image transfer body can have their service lives extended. If all the image carriers assigned to colors other than black are moved into and out of contact with the intermediate image transfer body at the same time, then a moving mechanism is simpler than when the image carriers are moved one by one.

(3) Black toner to be consumed more than the other toner is stored in a great amount and does not have to be frequently replenished. This facilitates user's maintenance.

(4) An image can be output in a color selected by the operator without regard to the color of a document. In addition, the image forming speed is increased. The image forming speed is further increased because there is saved a period of time necessary for the individual image carrier to move into and out of contact with the intermediate image transfer body.

Various modifications will become possible for those skilled in the art after receiving the teachings of the present disclosure without departing from the scope thereof.

What is claimed is:

1. An image forming apparatus comprising:

a plurality of image carriers;

a plurality of toner image forming means each for forming a toner image of a particular color on a respective one of said plurality of image carriers;

primary image transferring means comprising an intermediate image transfer body capable of contacting said plurality of image carriers, wherein toner images formed on said plurality of image carriers are sequentially transferred to said intermediate image transfer body one above the other by primary image transfer at positions where said image carriers contact said intermediate image transfer body, completing a composite toner image; and secondary image transferring means for transferring the composite toner image from said intermediate image transfer body to a recording medium by secondary image transfer; and a first memory configured to store data to be used to form the toner image of a first color and a second memory configured to store data to be used to form the toner image of a second color different than the first color;

wherein said image forming apparatus is selectively operable in a first mode that uses all of said plurality of toner image forming means or a second mode that uses at least one of said plurality of toner image forming means, but does not use at least one of said plurality of toner image forming means, and in said second mode, the image carrier associated with the toner image forming means not joining in image formation is moved from the surface of said intermediate image transfer body at least until an end of the primary image transfer.

2. The apparatus as claimed in claim 1, wherein toner images are capable of being formed on said plurality of image carriers in a plurality of colors including black, and a black toner image is formed in said second mode.

3. The apparatus as claimed in claim 2, wherein black toner is stored in said apparatus in a greater amount than toner of the other colors.

4. An image forming apparatus comprising:

a plurality of image carriers;

a plurality of toner image forming means each for forming a toner image of a particular color on a respective one of said plurality of image carriers;

primary image transferring means comprising an intermediate image transfer body capable of contacting said plurality of image carriers, wherein toner images formed on said plurality of image carriers are sequentially transferred to said intermediate image transfer body one above the other by primary image transfer at positions where said image carriers contact said intermediate image transfer body, completing a composite toner image; and secondary image transferring means for transferring the composite toner image from said intermediate image transfer body to a recording medium by secondary image transfer;

wherein said image forming apparatus is selectively operable in a first mode that uses all of said plurality of toner image forming means or a second mode that uses at least one of said plurality of toner image forming means, but does not use at least one of said plurality of toner image forming means, in said second mode, the image carrier associated with the toner image forming means not joining in image formation is released from a surface of said intermediate image transfer body at least until an end of the primary image transfer, and assuming that a plurality of image data capable of being continuously output include both of first image data to be processed in said first mode and second image data to be processed in said second mode, said first image data and said second image data are respectively written to a first memory and a second memory to be thereby continuously output one after the other.

5. An image forming apparatus comprising:

a plurality of image carriers;

a plurality of toner image forming means each for forming a toner image of a particular color on a respective one of said plurality of image carriers;

primary image transferring means comprising an intermediate image transfer body capable of contacting said plurality of image carriers, wherein toner images formed on said plurality of image carriers are sequentially transferred to said intermediate image transfer body one above the other by primary image transfer at positions where said image carriers contact said intermediate image transfer body, completing a composite toner image;

secondary image transferring means for transferring the composite toner image from said intermediate image transfer body to a recording medium by secondary image transfer; and color inputting means for allowing an operator to input a desired color in which an image should be output;

wherein said image forming apparatus is selectively operable in a first mode that uses all of said plurality of toner image forming means or a second mode that uses at least one of said plurality of toner image forming means, but does not use at least one of said plurality of toner image forming means, and in said second mode, the image carrier associated with the toner image forming means not joining in image formation is released from a surface of said intermediate image transfer body at least until an end of the primary image transfer.

6. The apparatus as claimed in claim 5, wherein assuming that a plurality of image data capable of being continuously output include both of first image data to be processed in said first mode and second image data to be processed in said second mode, said first image data and said second image data are respectively written to a first memory and a second memory to be thereby continuously output one after the other.

7. An image forming apparatus comprising:

a plurality of image carriers;

a plurality of toner image forming means each for forming a toner image of a particular color on a respective one of said plurality of image carriers;

primary image transferring means comprising an intermediate image transfer body capable of contacting said plurality of image carriers, wherein toner images formed on said plurality of image carriers are sequentially transferred to said intermediate image transfer body one above the other by primary image transfer at positions where said image carriers contact said intermediate image transfer body, completing a composite toner image;

secondary image transferring means for transferring the composite toner image from said intermediate image transfer body to a recording medium by secondary image transfer; and color inputting means for allowing an operator to input a desired color in which an image should be output;

wherein said image forming apparatus is selectively operable in a first mode that uses all of said plurality of toner image forming means or a second mode that uses at least one of said plurality of toner image forming means, but does not use at least one of said plurality of toner image forming means, in said second mode, the image carrier associated with the toner image forming means not joining in image formation is released from a surface of said intermediate image transfer body at least until an end of the primary image transfer, toner images are capable of being formed on said plurality of image carriers in a plurality of colors including black, and a black toner image is formed in said second mode, and black toner is stored in said apparatus in a greater amount than toner of the other colors.

8. The apparatus as claimed in claim 7, wherein assuming that a plurality of image data capable of being continuously output include both of first image data to be processed in said first mode and second image data to be processed in said second mode, said first image data and said second image data are respectively written to a first memory and a second memory to be thereby continuously output one after the other.

9. An image forming apparatus comprising:

a first image forming body configured to form a first image of a first color;

a second image forming body configured to form a second image of a second color different than the first color;

an image transfer body configured to contact the first and second image forming bodies and to receive the first and second images; and means for storing data to form the first image of the first color separate from data to form the second image of the second color.

* * * * *